US006848847B2

(12) United States Patent
Murakoshi et al.

(10) Patent No.: US 6,848,847 B2
(45) Date of Patent: Feb. 1, 2005

(54) PRINTER UNIT AND PRINTING APPARATUS INCORPORATING THE SAME

(75) Inventors: Keiji Murakoshi, Nagano (JP); Takashi Aoki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/295,025

(22) Filed: Nov. 15, 2002

(65) Prior Publication Data

US 2003/0103793 A1 Jun. 5, 2003

(30) Foreign Application Priority Data

Nov. 16, 2001 (JP) ..... P2001-352184

(51) Int. Cl.[7] ..... B41J 11/66
(52) U.S. Cl. ..... 400/621; 400/621.1; 400/611
(58) Field of Search ..... 400/621, 621.1, 400/621.2, 611

(56) References Cited

U.S. PATENT DOCUMENTS

| | | | | |
|---|---|---|---|---|
| 5,833,380 A | * | 11/1998 | Hosomi et al. | 400/621 |
| 6,102,596 A | | 8/2000 | Komori et al. | |
| 6,155,731 A | * | 12/2000 | Bertalan et al. | 400/621 |
| 6,270,270 B2 | * | 8/2001 | Koshi et al. | 400/621 |
| 6,343,884 B1 | * | 2/2002 | Watanabe et al. | 400/621 |
| 6,347,897 B2 | * | 2/2002 | Huggins et al. | 400/621 |
| 6,361,231 B1 | * | 3/2002 | Sato et al. | 400/621 |
| 6,443,645 B1 | * | 9/2002 | Takei et al. | 400/621 |
| 6,508,600 B1 | * | 1/2003 | Nonaka | 400/621 |
| 6,565,273 B2 | * | 5/2003 | Yamada | 400/512 |

FOREIGN PATENT DOCUMENTS

| | | |
|---|---|---|
| EP | 0 901 890 | 3/1999 |
| JP | 3-32868 | 2/1991 |
| JP | 7-266642 | 10/1995 |
| JP | 9-86000 | 3/1997 |
| JP | 10-272811 | 10/1998 |
| JP | 10-309836 | 11/1998 |
| JP | 11-10966 | 1/1999 |

* cited by examiner

*Primary Examiner*—Daniel J. Colilla
*Assistant Examiner*—Dave A. Ghatt
(74) *Attorney, Agent, or Firm*—Nixon & Vanderhye P.C.

(57) ABSTRACT

A paper feeding roller rotates to feed the continuous paper along a paper path. A print head performs printing on the continuous paper. The print head has a first side opposing to the paper path and a second side opposite to the first side. A cutter mechanism is overlappingly disposed with the print head, at a downstream of the paper path relative to the print head, to cut the continuous paper. A motor is disposed in the second side of the print head to provide a driving force to the paper feeding roller and the cutter mechanism. A cutter driving mechanism is disposed in the second side of the print head to transmit the driving force of the motor to operate the cutter mechanism.

11 Claims, 17 Drawing Sheets

PRINTER UNIT AND PRINTING APPARATUS INCORPORATING THE SAME

BACKGROUND OF THE INVENTION

The invention relates to a printer unit having a cutter mechanism for cutting continuous paper such as rolled paper, and a printing apparatus incorporating such a printer unit.

In the related art, one type of printing apparatus is known that includes a cutter mechanism for automatically cutting the paper to separate a printed portion from the rolled paper after printing. In order to reduce margins of the paper, the printing apparatus of this type preferably has a print head and a cutter mechanism, which are positioned as closely to each other as possible. To this end, in many printing apparatuses, the cutter mechanism is placed in an overlapping manner downstream of the print head.

Portable devices and multi-processing systems, which have features of printing apparatus(es), have recently achieved widespread use. In a device of this type, restrictions are imposed on an integration space of a printer unit including a print head and a cutter mechanism. Particularly in the case of a portable device, the overall thickness of the device is determined by the thickness of the printer unit. Hence, strong demand exists for reducing the size, or slimming of the printer unit.

However, in the case of the related-art printer unit, a cutter driving motor and a cutter driving mechanism are built into the cutter mechanism (cutter unit), and the cutter mechanism and the print head (head unit) are arranged in an overlapping manner, thus posing limitations on slimming of the printer unit.

SUMMARY OF THE INVENTION

It is therefore an object of the invention to provide a slimmed printer unit while a print head and a cutter mechanism are arranged in the overlapping manner, and which enables a reduction in the number of parts and simplification of a control circuit by obviating a motor dedicated for a cutter.

It is also an object of the invention to provide a printing apparatus incorporating such a printer unit.

In order to achieve the above objects, according to the invention, there is provided a printer unit, comprising:

- a paper feeding roller, rotating to feed the continuous paper along a paper path;
- a print head, which performs printing on the continuous paper, the print head having a first side opposing to the paper path and a second side opposite to the first side;
- a cutter mechanism, overlappingly disposed with the print head, and downstream of the paper path relative to the print head, to cut the continuous paper;
- a motor, disposed in the second side of the print head to provide a driving force to the paper feeding roller and the cutter mechanism; and
- a cutter driving mechanism, disposed in the second side of the print head to transmit the driving force of the motor to operate the cutter mechanism.

In such a configuration, since the cutter driving mechanism is placed to utilize a back space behind the print head, the printer unit can be slimmed although the print head and the cutter mechanism are arranged in the overlapping manner. Further, a motor specifically designed for use with a cutter is obviated, thereby enabling a reduction in the number of parts and simplification of a control circuit.

Preferably, the cutter driving mechanism includes: a worm, extending parallel with a support axis of the paper feeding roller and a rotation axis of the motor, and rotated by the driving force of the motor; and a worm wheel, which meshes with the worm to transmit the driving force to the cutter mechanism.

In such a configuration, the driving force of the motor can be supplied to the paper feeding roller and the cutter driving mechanism by use of a simple gear mechanism while making the cutter mechanism compact.

Here, the cutter mechanism may include a movable blade formed with an elongated hole. The worm wheel may be provided with a joint extending parallel with a rotation axis of the worm wheel, and interlocked with the elongated hole. The movable blade may be reciprocated within a predetermined range in accordance with an interlocking movement of the joint in the elongated hole.

Here, the cutter mechanism may include a stationary blade arranged so as to oppose to the movable blade through the paper path in between. The movable blade is brought into slidable contact with the stationary blade to scissor off the continuous paper.

Further, it is preferable that the cutter driving mechanism includes a detector which detects a reference position of the worm wheel.

Here, the detector may include a cam formed with the worm wheel, and a sensor, which senses an outer circumferential face of the cam.

Preferably, the printer unit further comprises a switching mechanism, which selectively transmits the driving force of the motor to either the paper feeding roller or the cutter mechanism in accordance with a rotating direction of the motor.

In such a configuration, since a transmission channel is switched in accordance with the rotating direction of the motor, a clutch mechanism using a solenoid or the like is obviated, thereby enabling a reduction in the number of parts and simplification of structure of the motor.

Here, the switching mechanism may include: a sun gear, rotated by the motor; and a pair of planetary gears, meshed with the sun gear movably around an outer periphery of the sun gear. Either one of the planetary gear may mesh with one of the paper feeding roller and the cutter mechanism in accordance with the rotating direction of the motor.

In such a configuration, the transmission channel is switched by use of the planetary gear mechanism, thereby promoting a reduction in the number of parts and simplification of structure of the printer unit.

Preferably, the print head is a thermal head, and the paper feeding roller is a platen roller opposing to the print head.

Preferably, the print head, the cutter mechanism, the motor, and the cutter driving mechanism are disposed at a casing body of a printing apparatus having a housing section which houses the continuous paper therein, and the paper feeding roller is disposed at a cover body of the printing apparatus which opens or closes the housing section.

According to the invention, there is also provided a printing apparatus comprising the above described printer unit.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
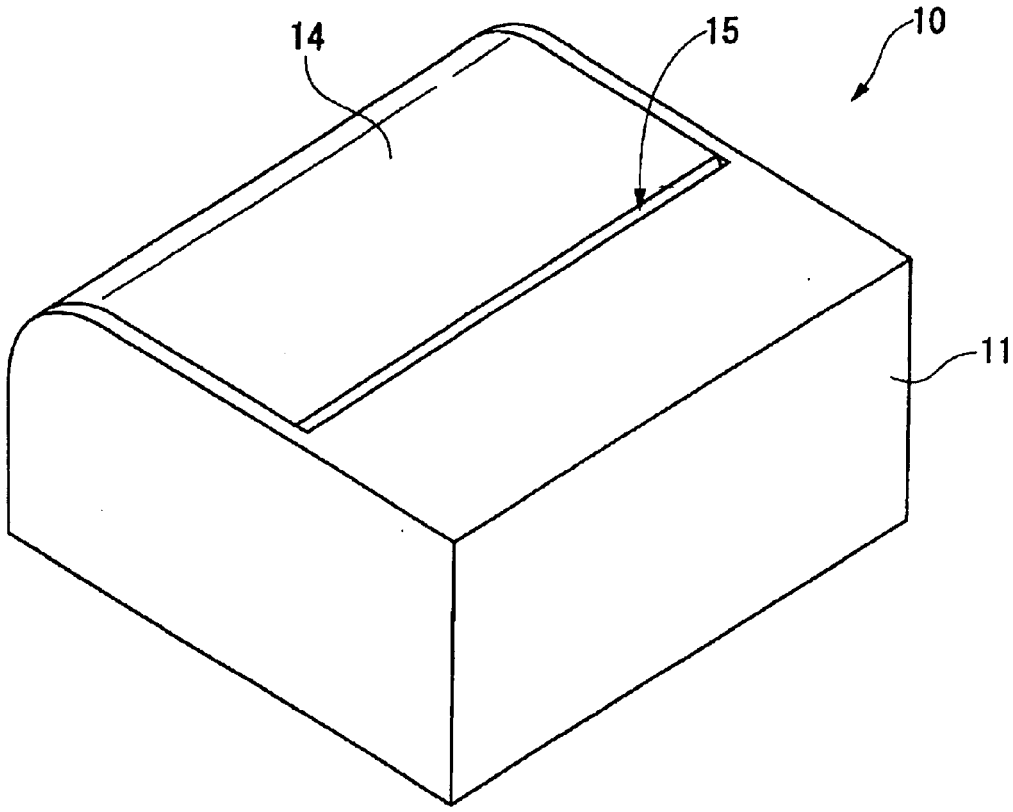
FIG. 1 is a perspective view of a printing apparatus when a cover is closed.
Figure 2:
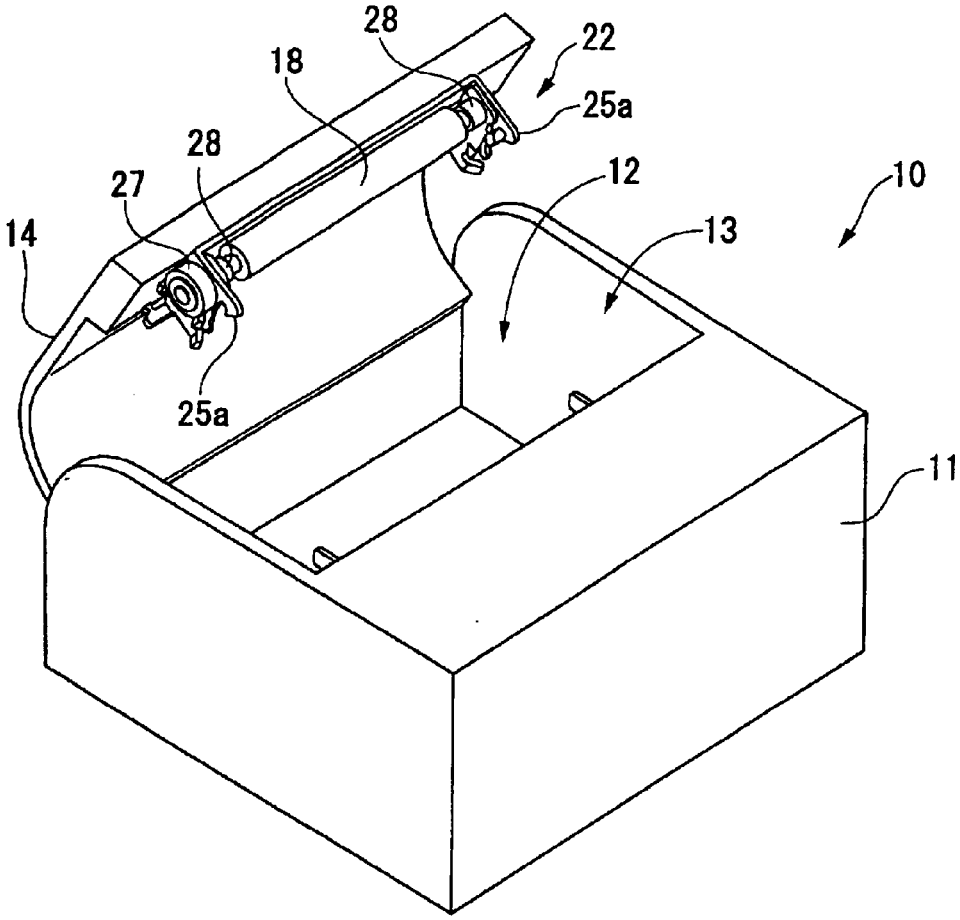
FIG. 2 is a perspective view of the printing apparatus when the cover is opened.
Figure 3:
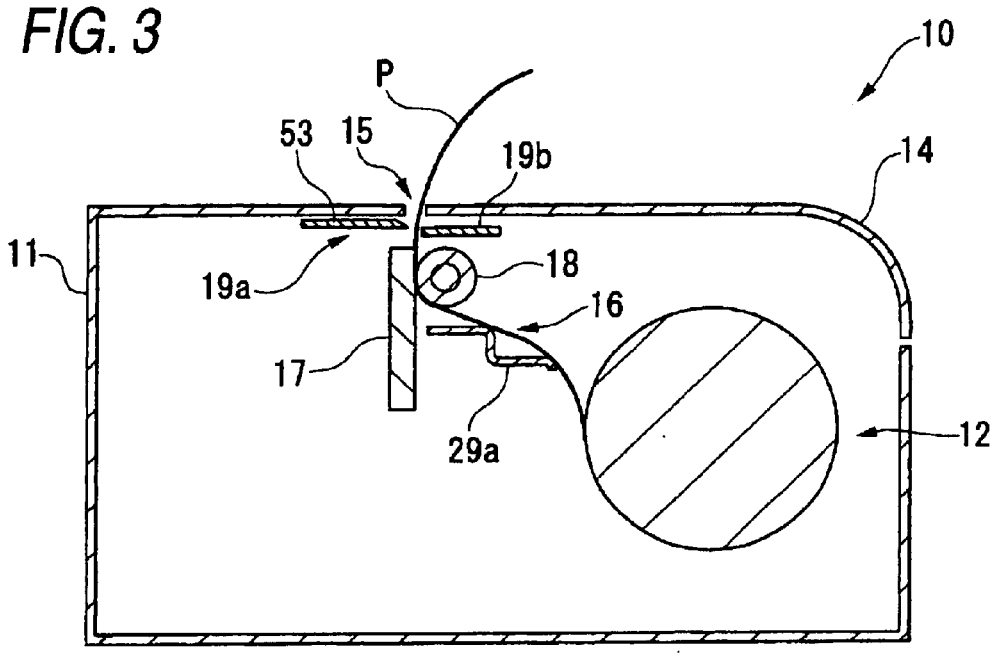
FIG. 3 is a schematic cross-sectional view of the printing apparatus.
Figure 4:
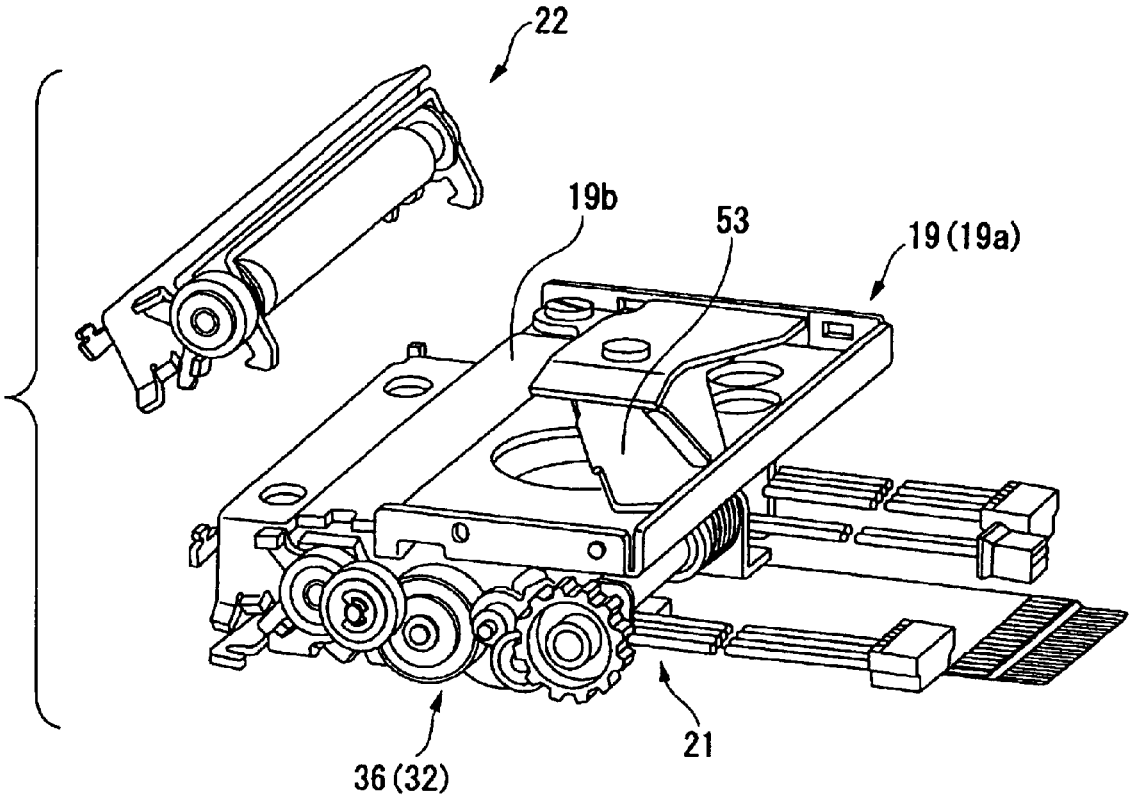
FIG. 4 is an entire perspective view of a printer unit.
Figure 5:
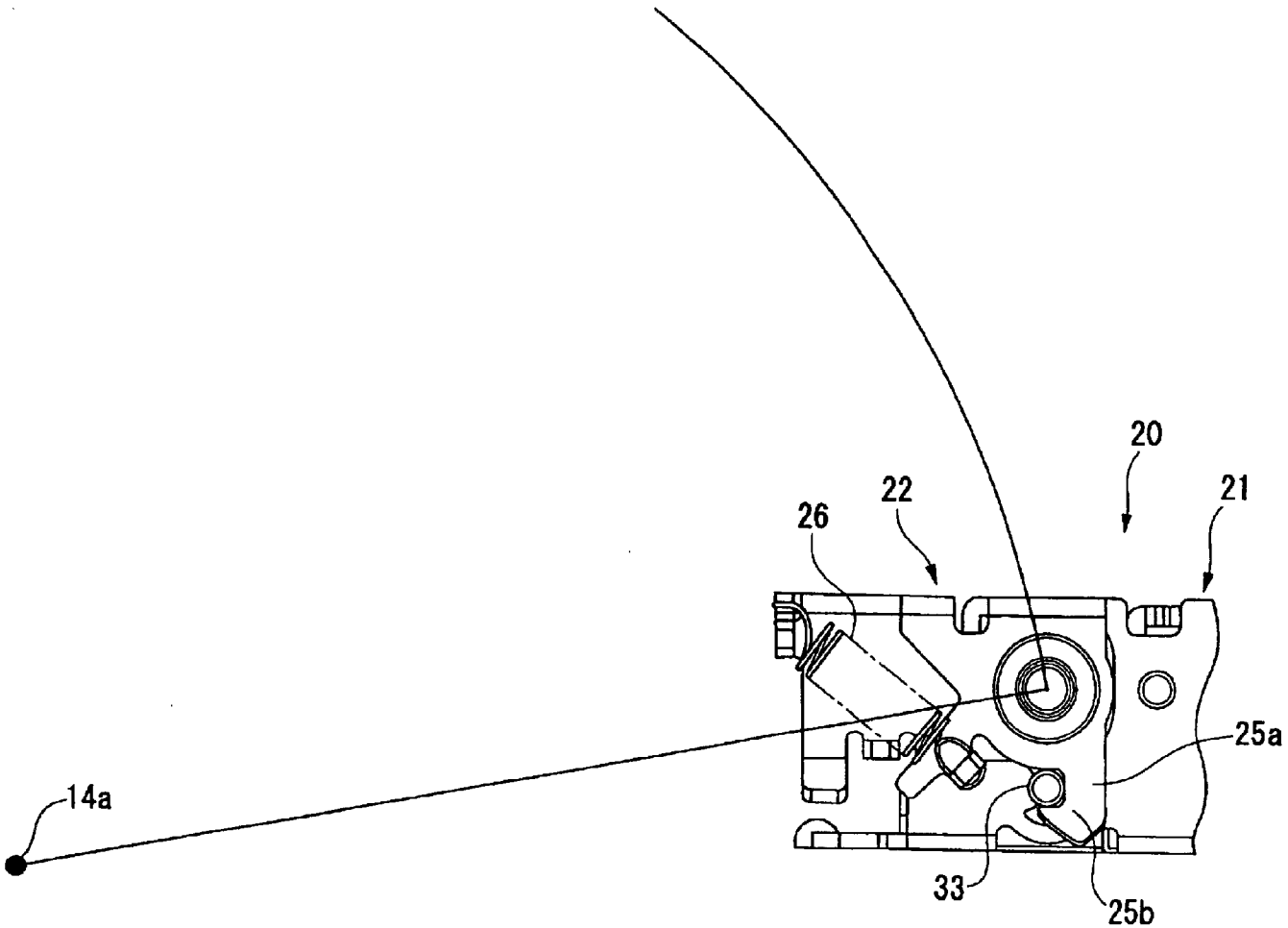
FIG. 5 is a fragmentary side view of the printer unit when the cover is closed, showing a state that cutter-related members are omitted.
Figure 6:
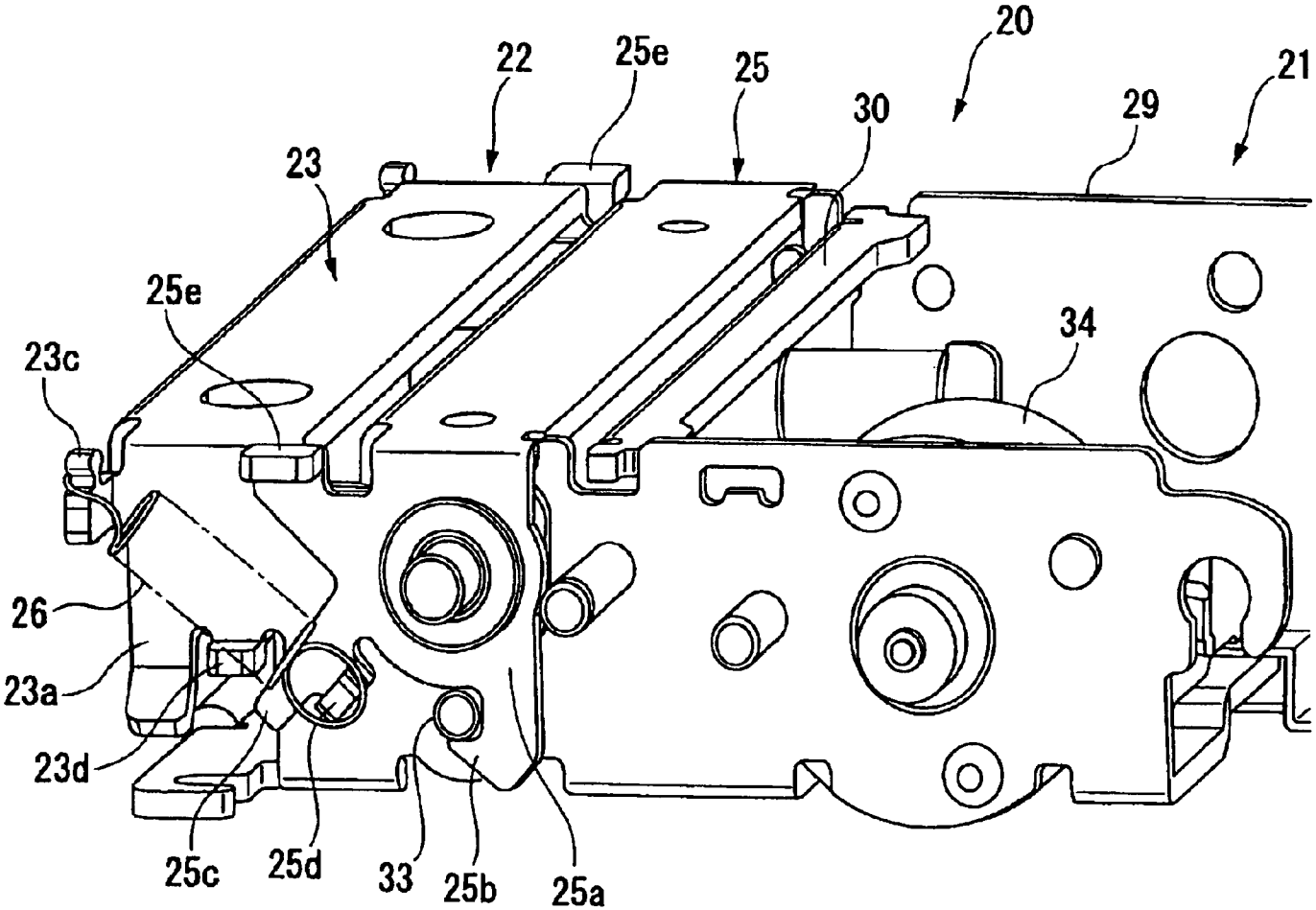
FIG. 6 is a perspective view of the printer unit when the cover is closed, showing a state that cutter-related members are omitted.
Figure 7:
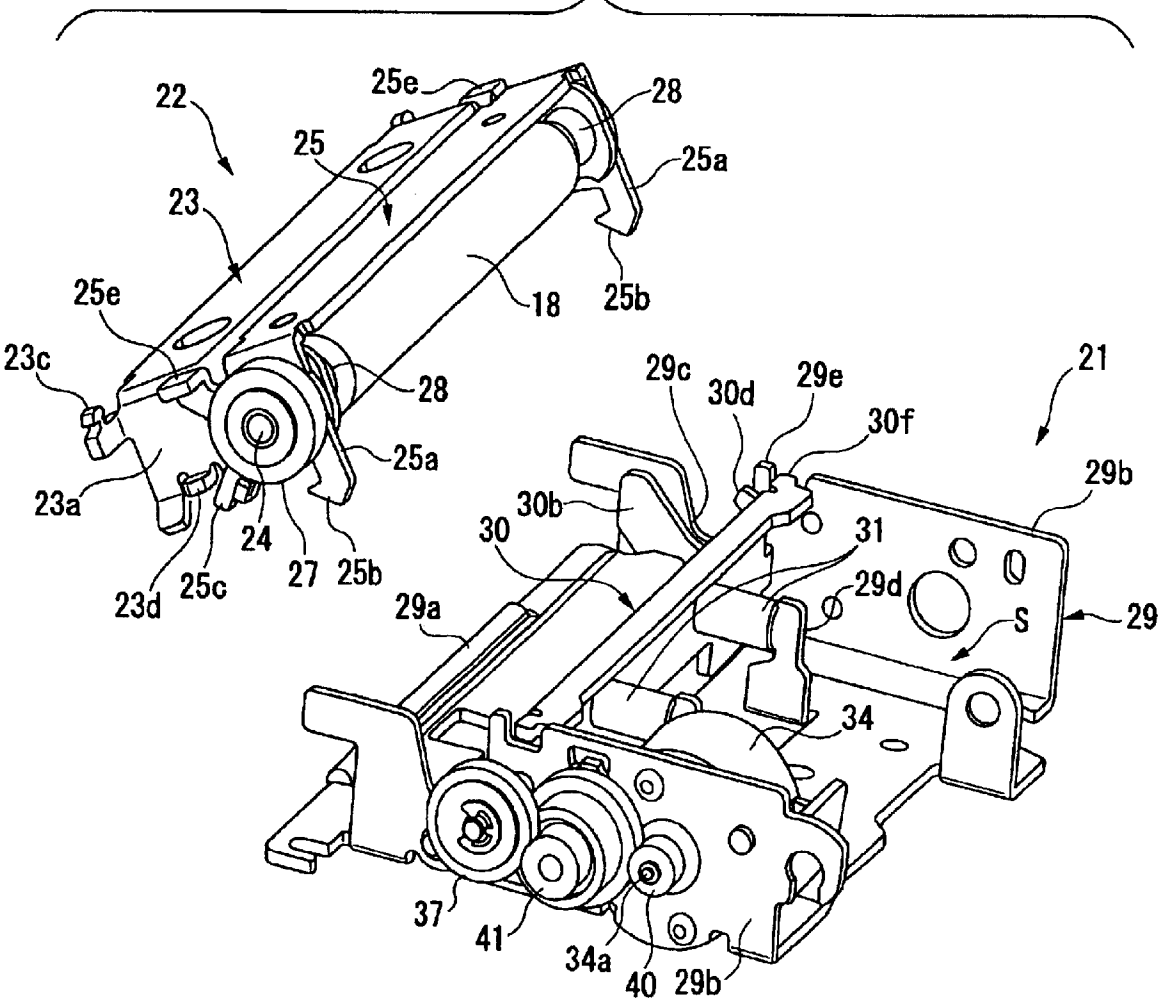
FIG. 7 is a perspective view of the printer unit when the cover is opened, showing a state that cutter-related members are omitted.
Figure 8:
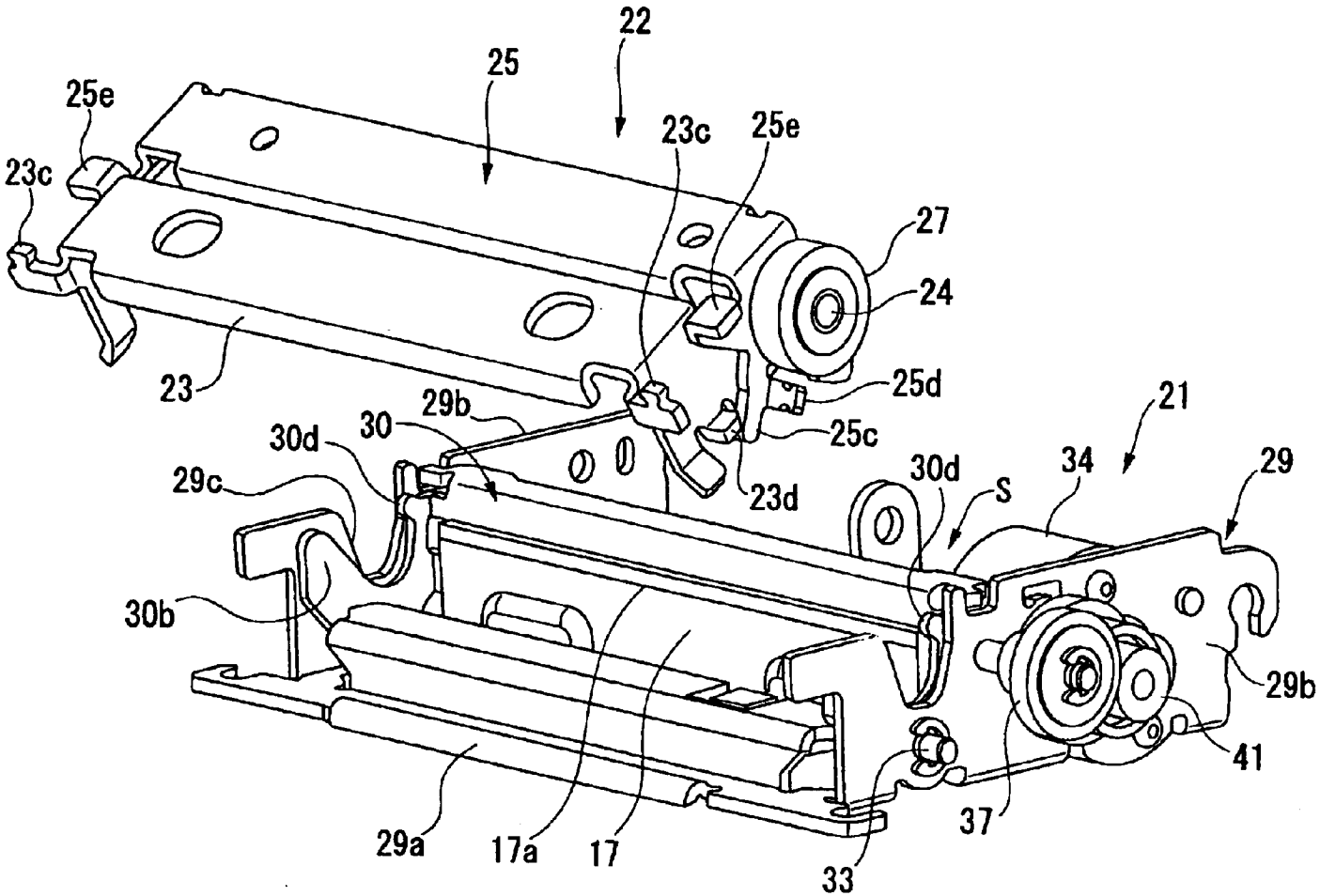
FIG. 8 is a perspective view of the printer unit shown in FIG. 7 when viewed from another angle, showing a state that cutter-related members are omitted.

An embodiment of the invention will be described hereinbelow by reference to the accompanying drawings. As will be known from FIGS. 1 to 3, the printing apparatus 10 comprises a housing section 12 for housing rolled paper P as type of continuous paper is provided in a casing 11. An opening section 13 is formed above the housing section 12, and rolled paper P is replaced through the opening section 13. The opening section 13 is opened and closed by a cover 14 which is pivotable up and down while a rear end of the cover 14 is taken as a pivot. A slit-shaped discharging port 15 is formed between an front end of the cover 14 and a front edge of the opening section 13. One end of the rolled paper P rotatably retained in the housing section 12 is withdrawn from the discharging port 15 by way of a paper path 16.

Disposed along the paper path 16 are a thermal print head 17, a platen roller (paper feeding roller) 18 for transporting the rolled paper P at a position opposite the print head 17, and a cutter unit 19 (cutter mechanism 19*a*) for cutting the rolled paper P at a position downstream of the platen roller 18. When the printing apparatus 10 has received a print instruction, the print head 17 effects printing on the rolled paper P while the platen roller 18 feeds the rolled paper P. Subsequently, the printed portion of the paper is further advanced toward the discharging port 15. When the trailing end of the printed portion reaches a particular position relative to the cutter mechanism 19*a*, the cutter mechanism 19*a* cuts the paper to separate the printed portion from the paper unwound from the rolled paper P. The separated portion is then supplied from the discharging port 15 as a single cut sheet to a user.

As shown in FIGS. 4 to 8, a printing mechanism and a cutter mechanism of the printing apparatus 10 are assembled into a unit such as a printer unit 20, although cutter-related members are omitted from depiction.

The printer unit 20 comprises a head unit 21 to be provided on a main body of the printing apparatus (i.e., the casing 11), a platen unit (paper feeding unit) 22 to be provided on the cover 14, a cutter unit 19 disposed above (downstream) of the head unit 21 in an overlapping manner, and a stationary blade 19*b* provided above the platen unit 22. As a result, in a state in which the cover 14 is opened, the platen roller 18 and the stationary blade 19*b* retract from the print head 17, thereby opening a paper path 16. In other words, when the rolled paper P is replaced, the cover 14 is opened, and the rolled paper P is housed in the housing section 12. Subsequently, one end of the rolled paper P is drawn to the outside of the casing 11. In this state, the cover 14 is closed, whereby the rolled paper P is set along the paper path 16.

Figure 9:
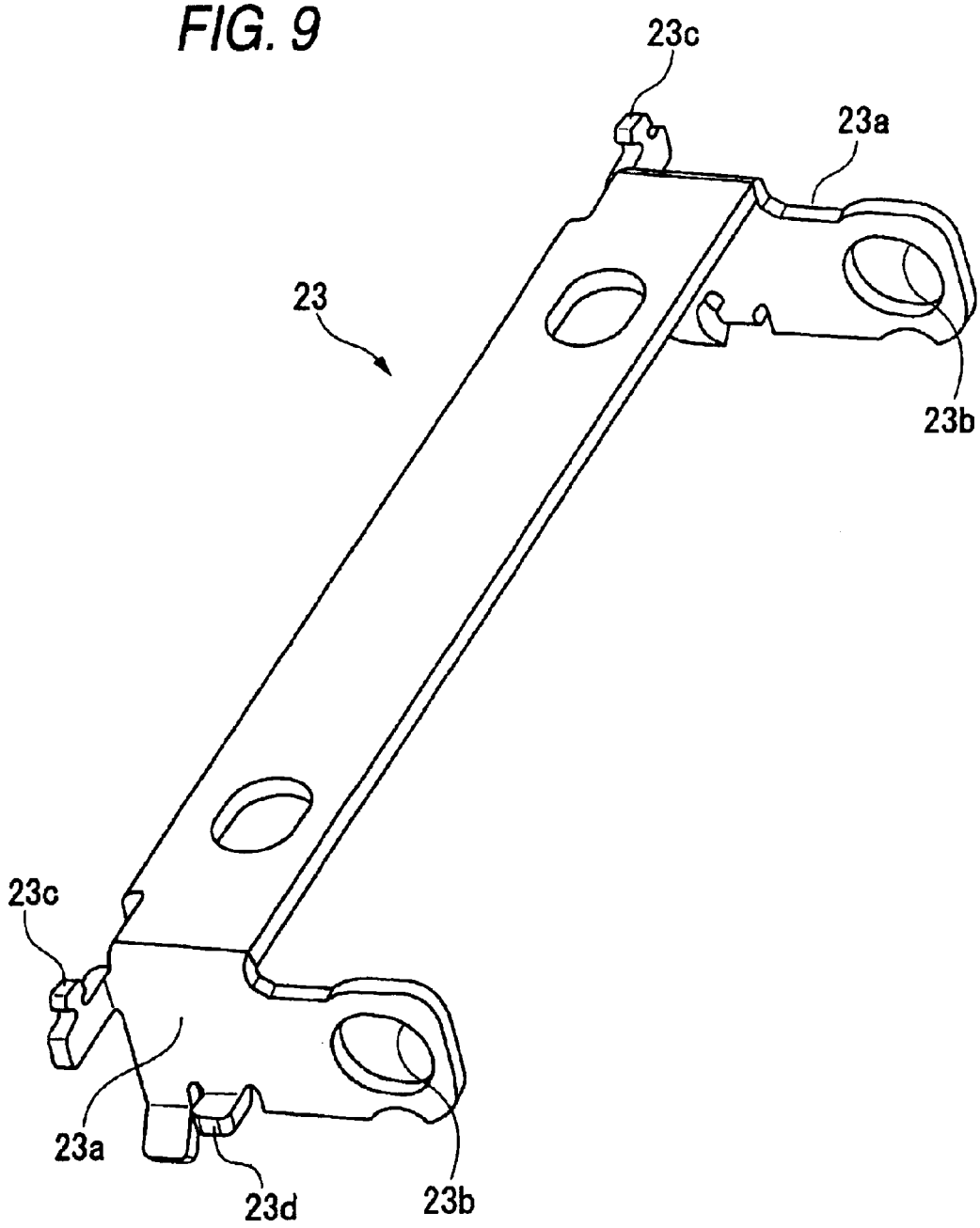
FIG. 9 is a perspective view of a platen frame.

The platen unit 22 comprises a platen frame 23 to be fixed on a lower face of the front end of the cover 14; a platen shaft 24 rotatably supported by the platen frame 23; a lock member 25 which pivots back and forth around the platen shaft 24; and springs 26 for urging the lock member 25 backward. As shown in FIG. 9, the platen frame 23 is formed so as to assume the shape of a gate when viewed from the front. Elongated platen support holes 23*b* are formed in respective side plates 23*a*. The platen roller 18 is provided integrally in an intermediate portion of the platen shaft 24. A platen gear 27 is provided integrally on the left end of the platen shaft 24. Both ends of the platen shaft 24 penetrate through corresponding platen support holes 23*b* and are supported by the platen frame 23 via bearing members 28. An inner side edge of each bearing member 28 extends toward the platen roller 18 so as to have a width wider than an additional thickness of a head frame 29 and a head support member 30 in an axial direction of the platen shaft 24.

Figure 10:
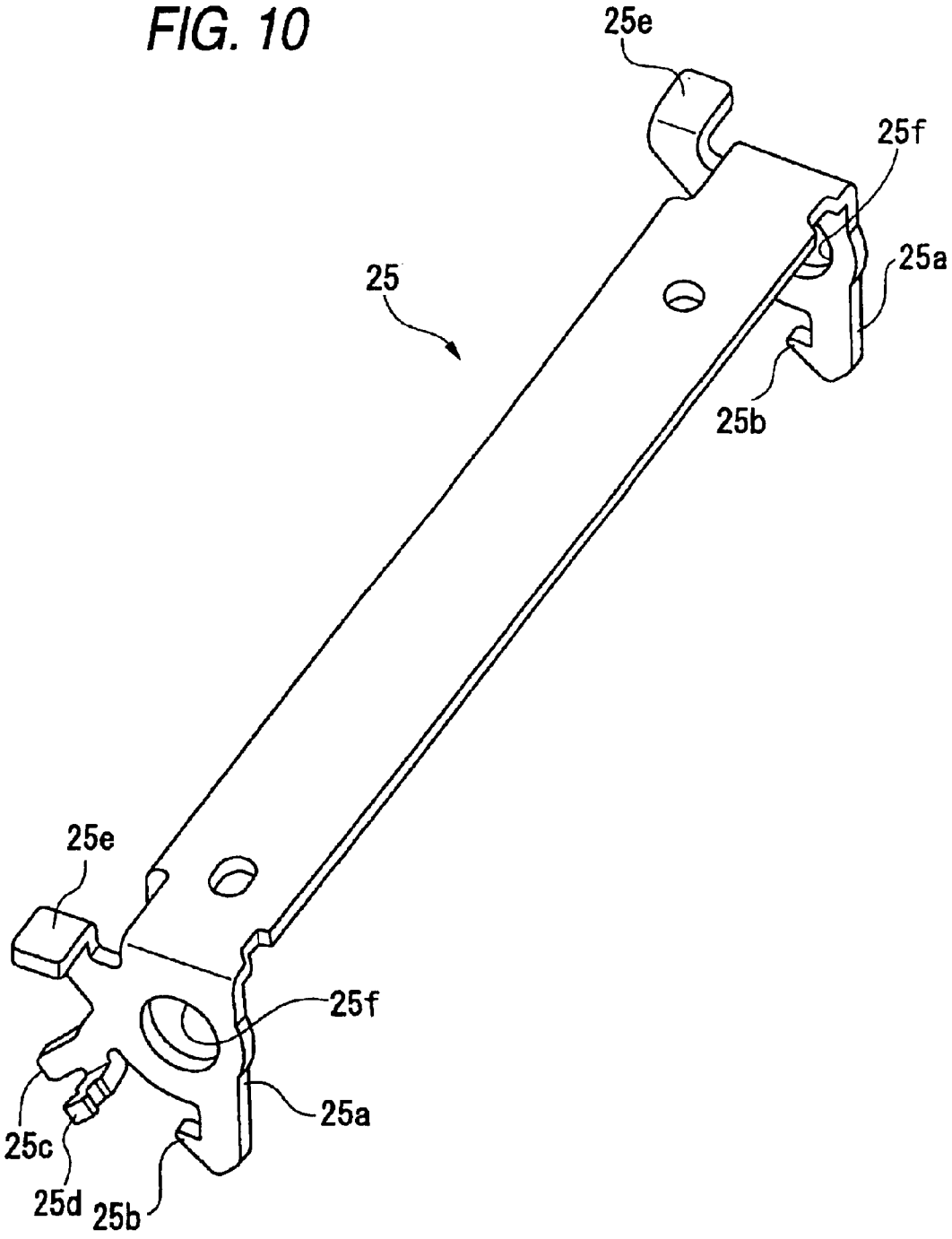
FIG. 10 is a perspective view of a lock member.

As shown in FIG. 10, the lock member 25 is formed so as to assume the shape of a gate when viewed from the front. A lock lever 25*a* is provided on either side of the lock member 25. Integrally formed in the lock lever 25*a* are an engagement hook 25*b*, a stopper piece 25*c*, a spring engagement piece 25*d*, an lock release piece 25*e*, and a support hole 25*f*. The support hole 25*f* is pivotably fitted around a corresponding bearing member 28. The lock member 25 is supported so as to be pivotable back and forth around the platen shaft 24.

Each of the springs 26 is interposed in a pulled state between a spring engagement piece 23*c* formed at the rear end of the platen frame 23 and the spring engagement piece 25*d* of the lock lever 25*a*. Further backward pivotal movement of the lock levers 25*a*, which are urged backward by the springs 26, is restricted as a result of the stopper pieces 25*c* coming into contact with stopper pieces 23*d* of the platen frame 23. At this time, the lock levers 25*a* are oriented in a direction substantially perpendicular to the cover 14, thereby avoiding projection of the lock levers 25*a* from the extremity of the cover 14. In place of the stopper pieces 23*d* of the platen frame 23, projections projecting outside from side plates 23*a* may be formed.

The head unit 21 comprises a head frame 29 to be mounted on the main body of the printing apparatus; a head support member 30 to be provided on the head frame 29 so as to be pivotable back and forth; springs 31 for urging the head support member 30 to the platen roller 18; and a drive system 32 for transmitting driving force to the platen roller 18 and the cutter mechanism 19*a*. The head frame 29 is formed so as to assume the shape of the letter U when viewed from the front. A step-shaped paper guide 29*a* (see FIG. 3) is formed at the rear end of the head frame 29 for guiding the rolled paper P drawn from the housing section 12 into a space defined between the print head 17 and the platen roller 18. A fitting groove 29*c* is formed in each of side plate sections 29*b* of the head frame 29. When the cover 14 is closed, the bearing members 28 are fitted into the fitting grooves 29*c* from above.

Figure 11:
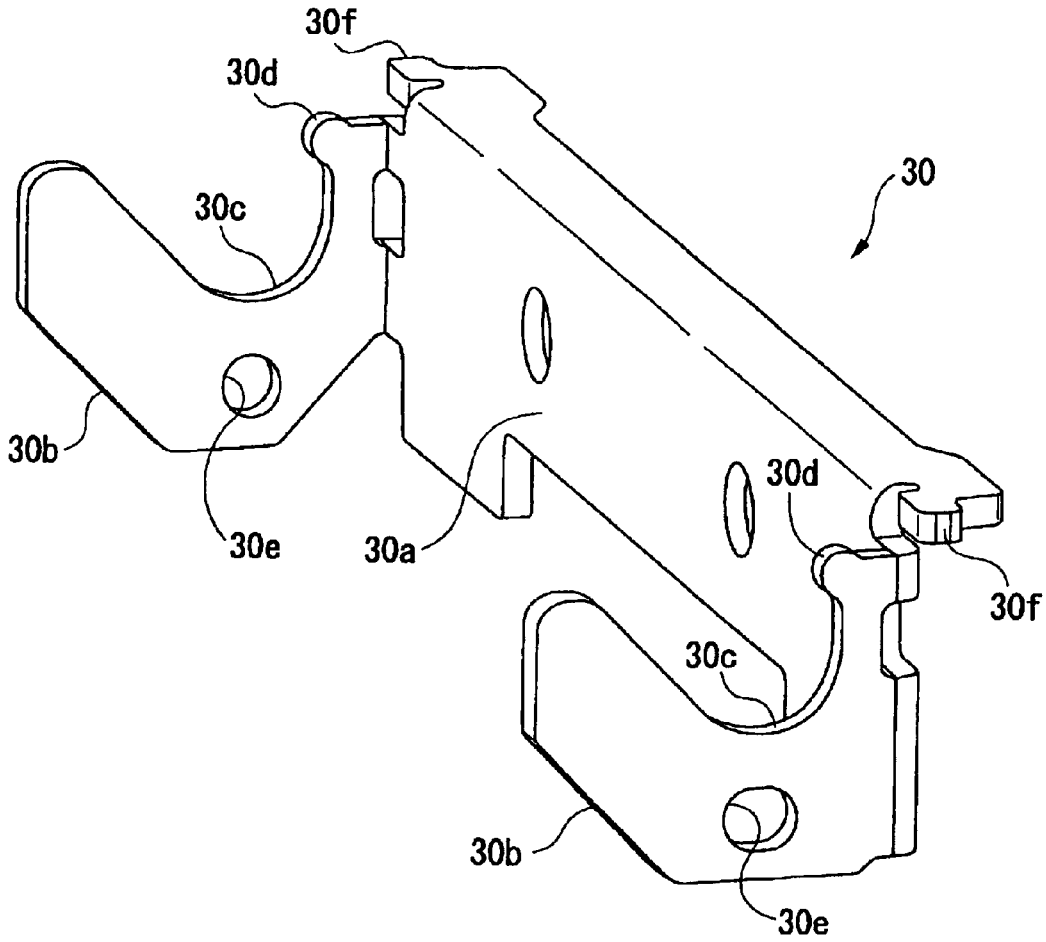
FIG. 11 is a perspective view of a head support member.
Figure 12:
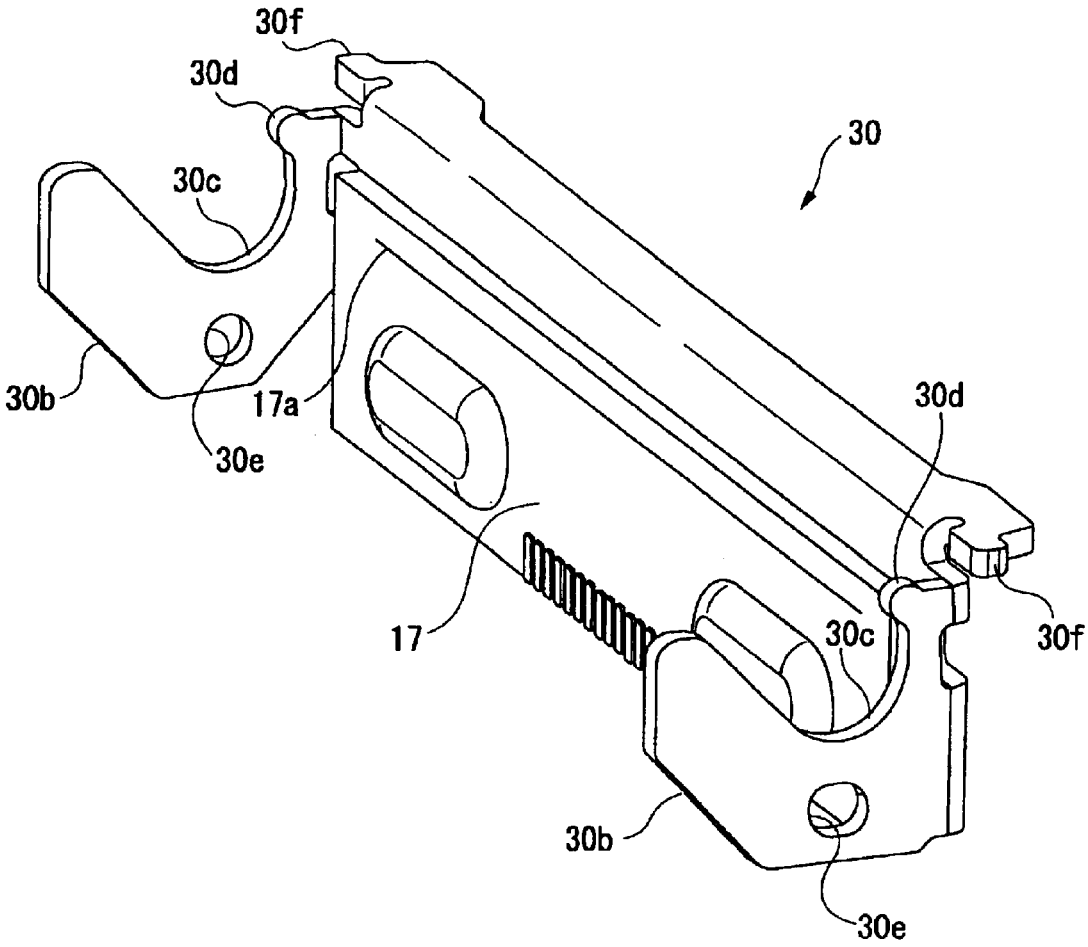
FIG. 12 is a perspective view of the head support member on which the print head is provided.
Figure 13:
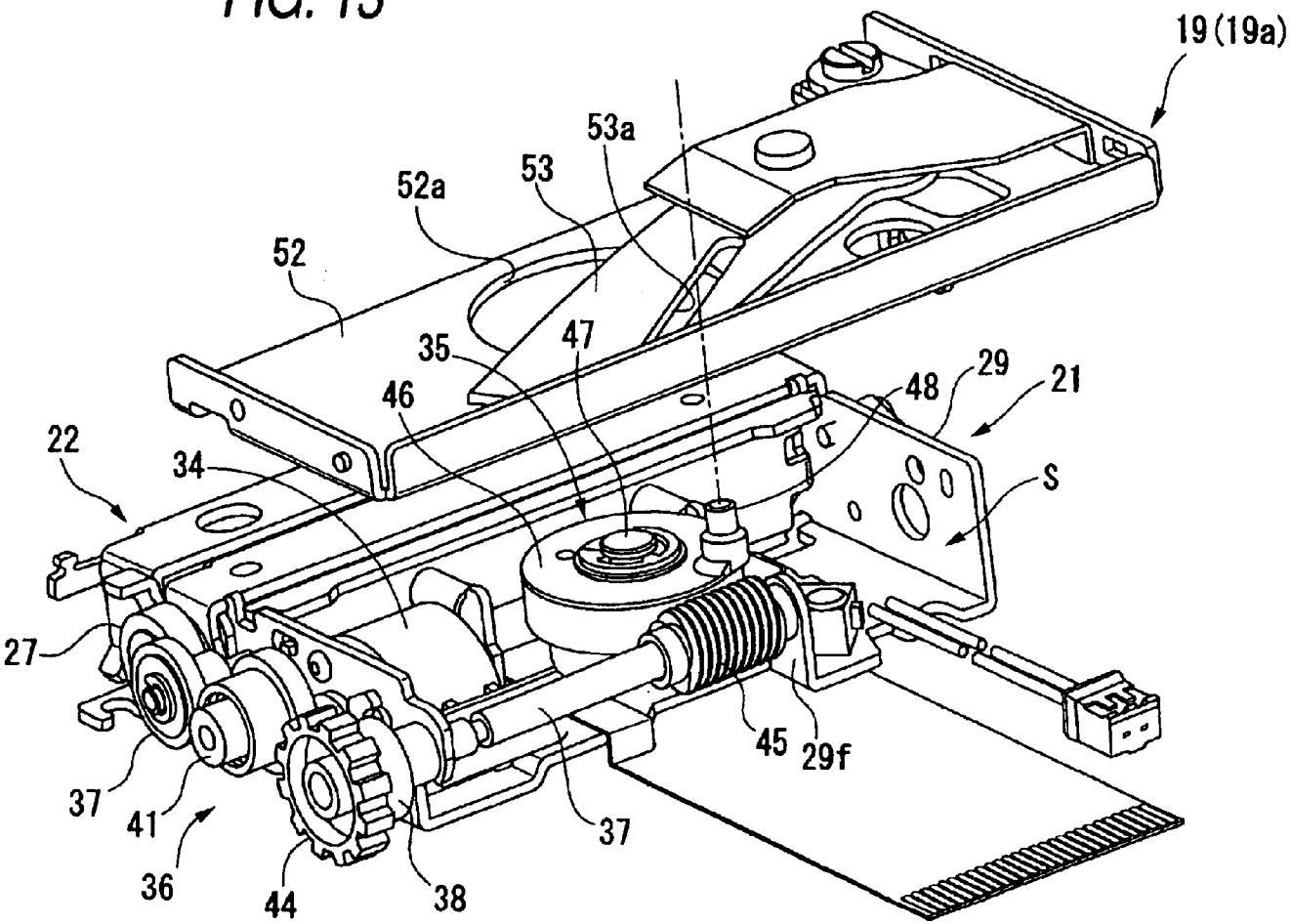
FIG. 13 is an exploded perspective view of the printer unit.
Figure 14:
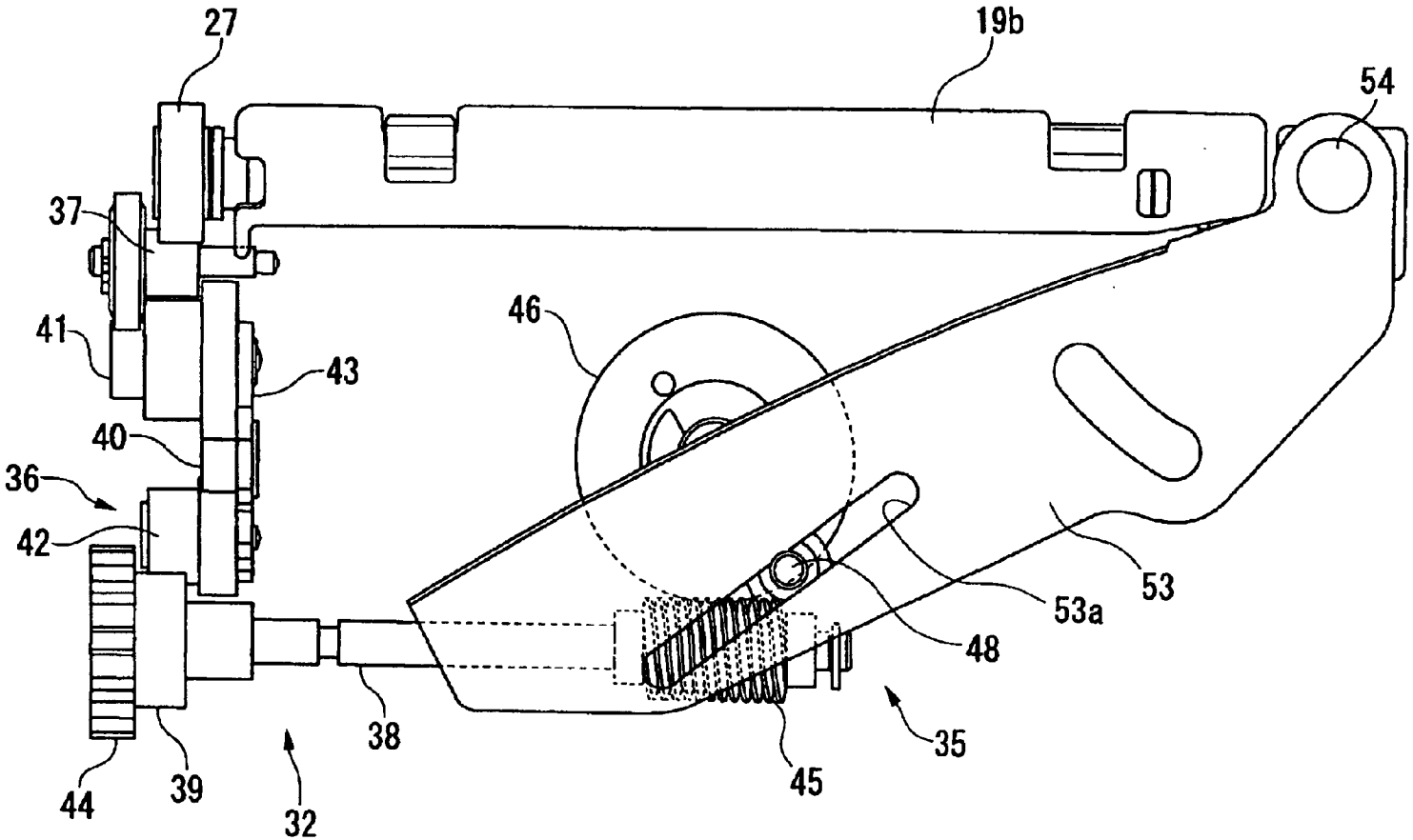
FIG. 14 is a plan view showing a drive system.
Figure 15:
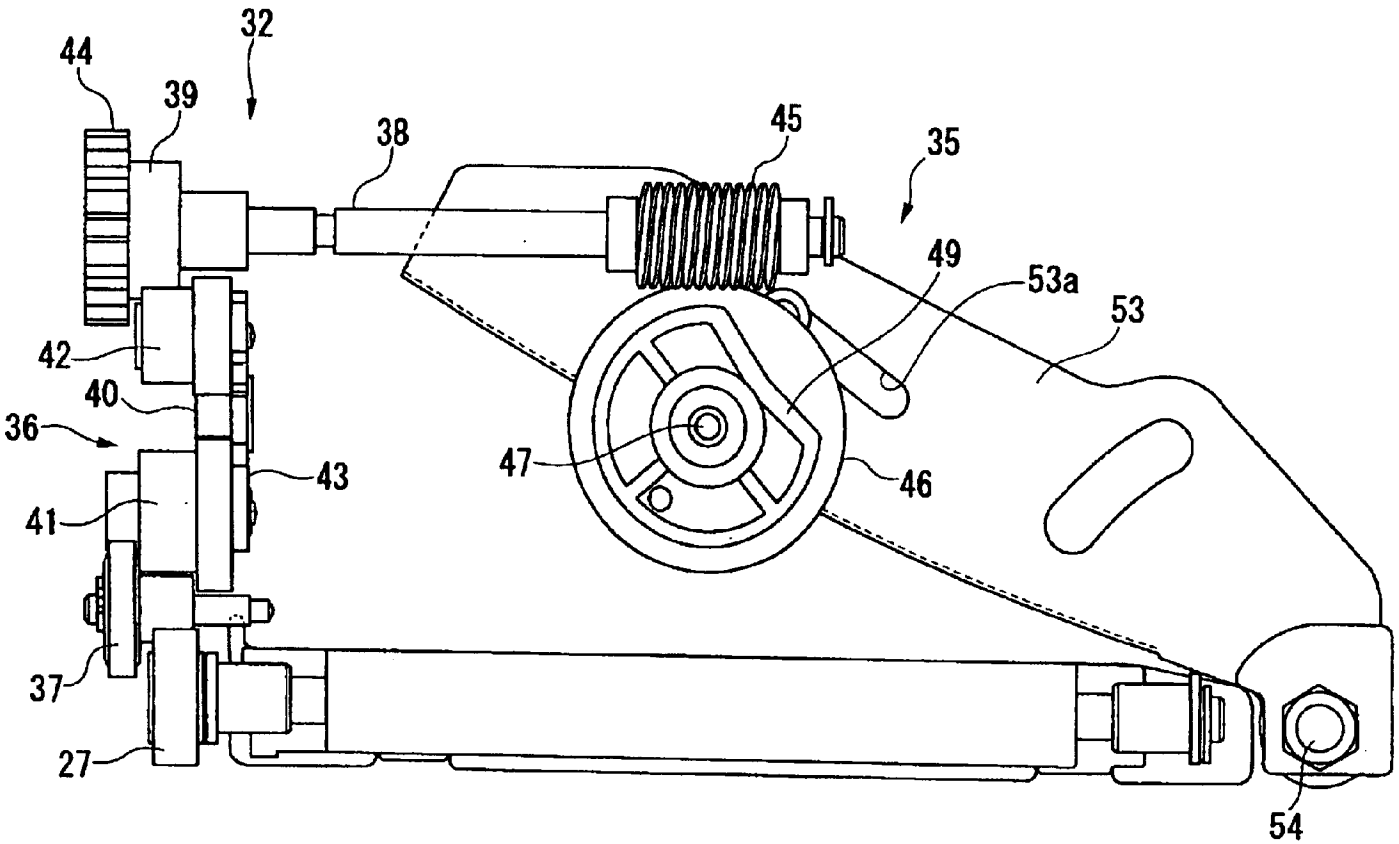
FIG. 15 is a bottom view showing the drive system.

As shown in FIGS. 11 and 12, the head support member 30 is formed so as to assume the shape of the letter U when viewed from the top. The print head 17 is bonded integrally to a supporting face 30*a* opposing the platen roller 18. The thermal print head 17 has the shape of a flat plate of specified thickness. A print line (heating element) 17*a* is formed at an upper front end so as to extend from side to side. In order to ensure print quality, the print head 17 of this type is required to press the rolled paper P against the print line 17*a*. In order to satisfy this requirement, the head support member 30 is disposed to rotate freely back and forth on the head frame 29 by way of the rotary shaft 33, and is urged to the platen roller 18 side by the springs 31.

An arm section 30*b* is provided on either side of the head support member 30 so as to extend backward. A fitting groove 30*c* is formed in each of the arm sections 30*b* such that the respective bearing members 28 fit into the grooves 30*c* from above when the cover 14 is closed. Further, a contact projection 30*d* is formed integrally on each arm section 30*b* so as to come into contact with a corresponding bearing member 28 and to cause the head support member 30 (print head 17) to temporarily retract from the platen roller 18. A support hole 30*e* is formed proximally below the fitting groove 30*c* on each of the arm sections 30*b*. The rotary shaft 33 penetrating through the support holes 30*e* is offset backward with reference to a printing face of the print head 17 (i.e., close to a pivot 14*a* of the cover 14). Both ends of the rotary shaft 33 also serve as locking shafts which engage the engagement hooks 25*b* of the lock levers 25*a*.

The springs 31 are interposed in a compressed state between the pair of spring support pieces 29*d* standing on the head frame 29 and the head support member 30 to be urged backward. As a result of stopper pieces 30*f* projecting from both ends of the head support member 30 coming into contact with the stopper pieces 29*e* of the head frame 29, further backward pivotal movement of the head support member 30 is restricted.

As shown in FIGS. 13 to 17, the drive system 32 comprises a motor 34 and a cutter driving mechanism 35 which are provided in a back space S behind the head frame 29 and the print head 17; and a gear train (switching mechanism) 36 for selectively transmitting drive power of the motor 34 to the platen gear 27 or the cutter driving mechanism 35. The gear train 36 comprises a paper feeding transmission gear 37 which meshes with the platen gear 27 when the cover 14 is closed; a cutter driving transmission gear 39 provided on an input shaft 38 of the cutter driving mechanism 35; a sun gear 40 provided on a motor shaft 34*a* of the motor 34; and a pair of planetary gears 41, 42 which mesh with the sun gear 40 at all times. The pair of planetary gears 41, 42 are rotatably provided at respective ends of a planetary lever 43 which rotates around the motor shaft 34*a* so as to revolve along the outer periphery of the sun gear 40 is allowed.

Figure 16:
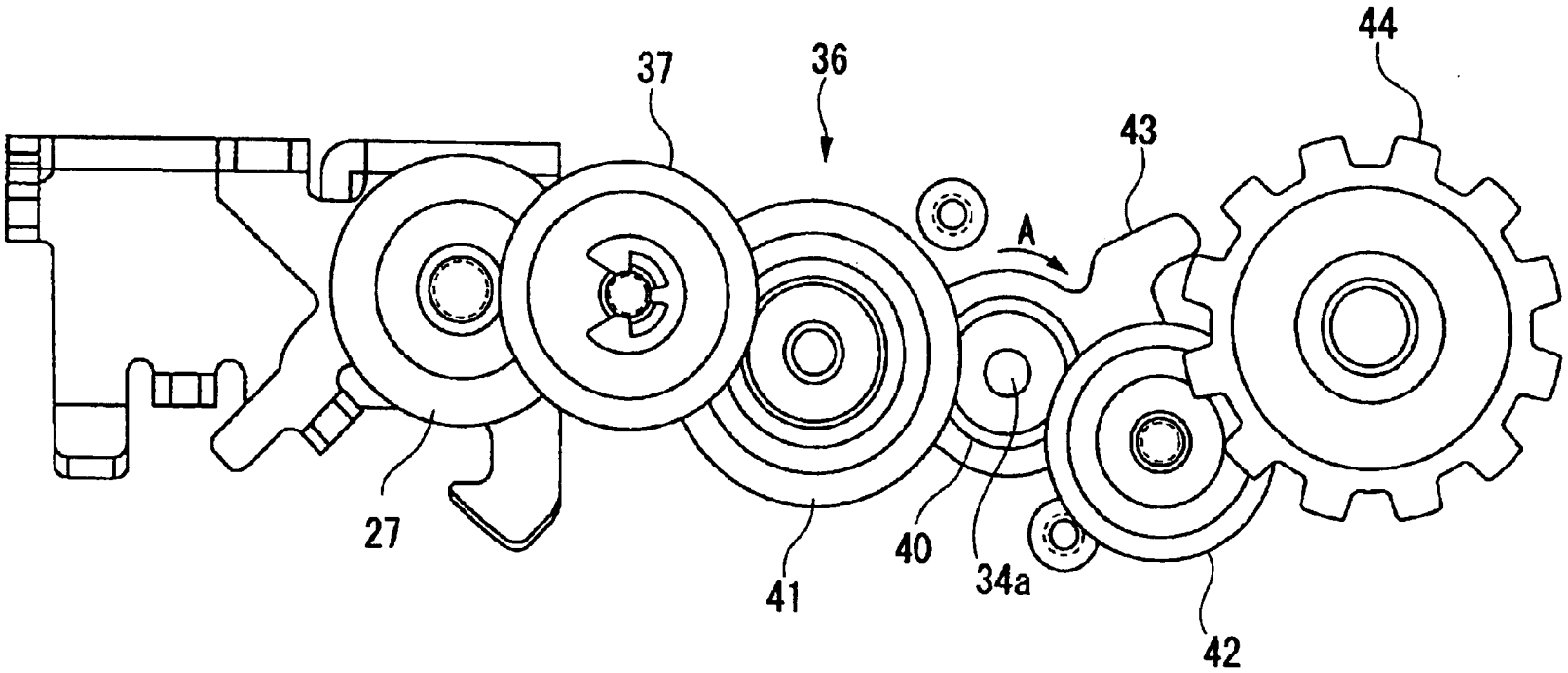
FIG. 16 is a side view of a gear train showing a paper feeding state.

As shown in FIG. 16, when the sun gear 40 is rotated in direction A, a paper feeding planetary gear 41 revolves in the direction A, thereby meshing with the paper feeding transmission gear 37. In this state, drive power of the motor 34 is transmitted to the platen gear 27 by way of the sun gear 40, the paper feeding planetary gear 41 and the paper feeding transmission gear 37, whereby the platen roller 18 feeds paper.

Figure 17:
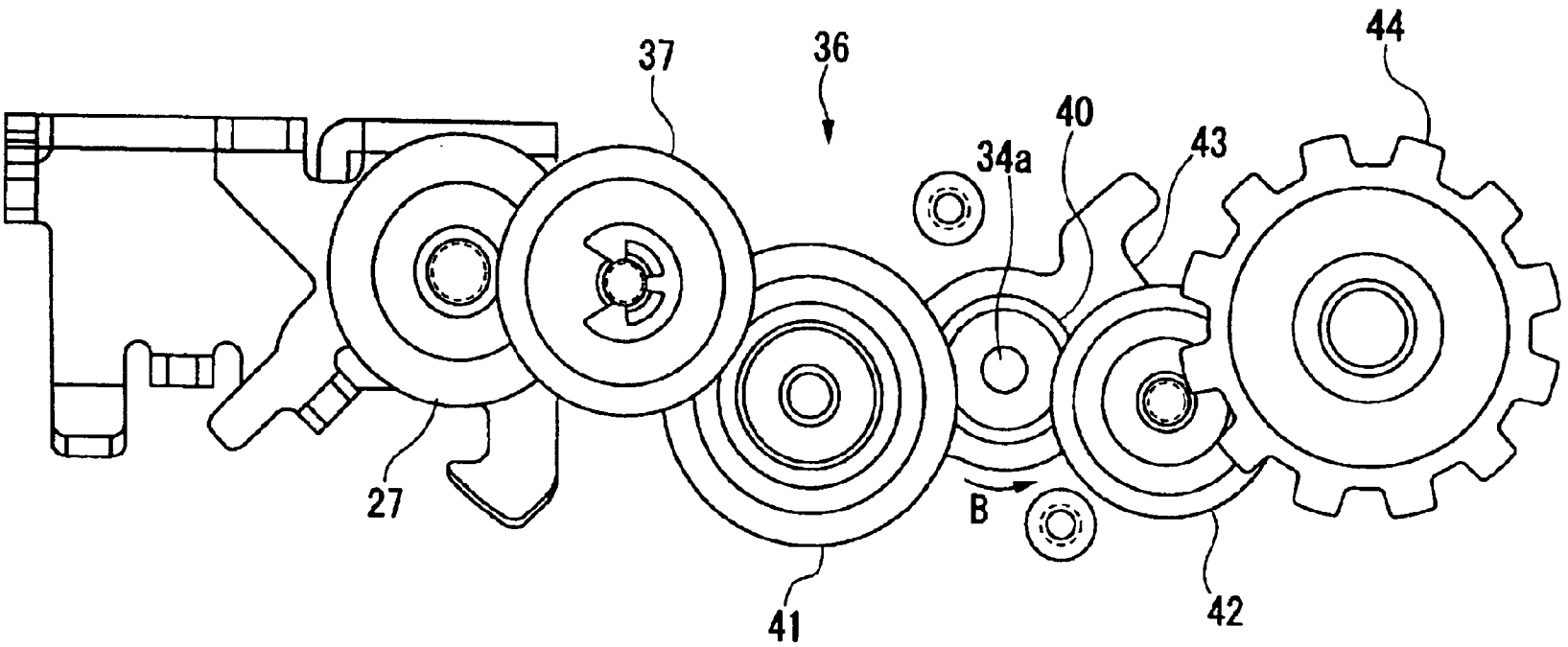
FIG. 17 is a side view of the gear train showing a cutter actuating state.

As shown in FIG. 17, when the sun gear 40 is rotated in direction B, a cutter driving planetary gear 42 revolves in the direction B, thereby meshing with the cutter driving transmission gear 39. In this state, the drive power of the motor 34 is transmitted to the cutter driving mechanism 35 via the sun gear 40, the cutter driving planetary gear 42 and the cutter driving transmission gear 39. The cutter driving mechanism 35 actuates the cutter mechanism 19*a*. The input shaft 38 of the cutter driving mechanism 35 is provided with a handle 44 for manually actuating the cutter mechanism 19*a* in the event of occurrence of a problem.

The cutter driving mechanism 35 comprises the input shaft 38 arranged parallel to the platen roller 18 and the motor shaft 34*a*; a worm 45 provided integrally with the input shaft 38, and a worm wheel 46 meshing with the worm 45. As mentioned above, the cutter driving mechanism 35 is disposed in the back space S behind the print head 17. The input shaft 38 is rotatably supported between the front end of the left side plate 29*b* of the head frame 29 and a raised piece 29*f* provided upright at an intermediate position along the front end of the head frame 29. The worm wheel 46 is rotatably supported by the head frame 29 by way of a vertically-oriented wheel shaft 47. A joint pin 48 is projectingly provided at an eccentric position on an upper face of the worm wheel 46. The cutter driving mechanism 35 is linked to the cutter mechanism 19*a* by way of the joint pin 48.

Figure 18:
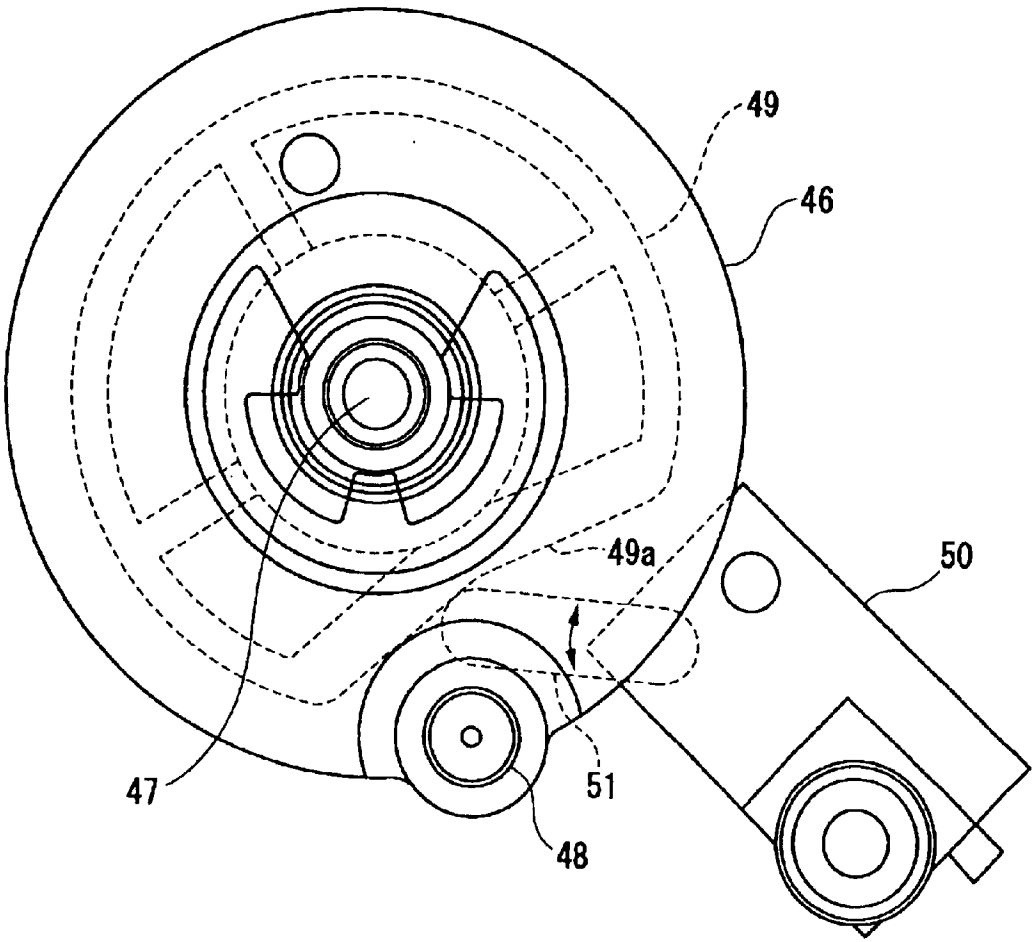
FIG. 18 is a plan view of a worm wheel.

As shown in FIG. 18, a position detection cam 49 is provided integrally on a lower face of the worm wheel 46. A detection lever 51 of a position detecting switch 50 is brought into pressing contact with an outer peripheral face of the cam 49. A recess 49*a* is formed in the cam 49 for detecting an initial position (e.g., a standby position or a reference position). When the recess 49*a* has reached the detection lever 51 at the time of actuation of a cutter, the position detecting switch 50 detects displacement of the lever resulting from arrival of the recess 49*a*, thereby deactivating the motor 34. A projection may be formed in place of the recess 49*a*, and the initial position may be detected when the position detecting switch 50 has detected the projection. Alternatively, the initial position may be detected in a non-contact manner through use of a photodetector.

The cutter unit 19 comprises a thin cutter frame 52 and a movable blade 53 which is provided on the cutter frame 52 so as to be pivotable back and forth by way of a movable blade pivot 54. A circular opening 52*a* matching the locus of movement of the joint pin 48 is formed in the cutter frame 52. The joint pin 48 projects into the cutter unit 19 through the opening 52*a*. The movable blade 53 has an elongated joint hole 53*a*, and the joint pin 48 is engaged with the joint hole 53*a*. Specifically, the movable blade 53 is constituted so as to make a round trip within a predetermined range of movement while following movement of the joint pin 48 when the worm wheel 46 has made one rotation. During the course of movement, the movable blade 53 comes into a slidable contact with the stationary blade 19 in the manner of scissors, thereby cutting the rolled paper P.

As mentioned above, according to the embodiment, since the cutter driving mechanism 35 is placed by utilization of the back space S behind the print head 17, the printer unit 20 can be slimmed although the print head 17 and the cutter mechanism 19*a* are placed in an overlapping manner. Further, a motor specifically designed for use with a cutter is obviated, thereby enabling an attempt to reduce the number of parts and simplification of a control circuit.

In addition, the worm 45 of the cutter driving mechanism 35 is positioned in parallel to the platen shaft 24 and the motor shaft 34*a* and rotates in association with activation of the motor 34. Correspondingly, the worm wheel 46 meshes with the worm 45 and activates the cutter mechanism 19*a* in accordance with rotation of the worm 45. In short, the cutter driving mechanism 35 is constituted by use of a worm mechanism having a large reduction ratio. Hence, there can be achieved compact construction of the cutter driving mechanism 35, as well as a reduction in the number of parts of the cutter driving mechanism 35. Further, because the worm 45 is disposed in parallel to the platen shaft 24 and the motor shaft 34*a*, the drive power of the motor can be supplied to the platen roller 18 and the cutter driving mechanism 35 through use of a simple gear mechanism.

Further, by providing the gear train 36 for selectively transmitting the drive power of the motor 34 to the platen roller 18 or the cutter mechanism 19*a* in accordance with the direction of rotation, a clutch mechanism using a solenoid is unnecessary, and the number of parts can be reduced and the structure can be simplified.

As mentioned above, the gear train 36 comprises the sun gear 40 which rotates in accordance with activation of the motor 34; and the planetary gears 41, 42 which mesh with the sun gear 40, are movable along an outer periphery of the sun gear 40, and selectively mesh with the paper feeding transmission gear 37 or the cutter driving transmission gear 39 in accordance with the direction of rotation of the sun gear 40. Specifically, a transmission channel is switched by use of a planetary gear mechanism, thereby promoting a reduction in the number of parts and simplification of structure.

Although the embodiment of the invention has been described by reference to the drawings, the invention is not limited to the items described in connection with the embodiment and encompasses a range in which a person skilled in the art can modify the invention or realize an application of the invention on the basis of the scope of the invention, the detailed description of the invention, and the related art.

What is claimed is:

1. A printer unit, comprising:

a paper feeding roller, rotating to feed the continuous paper along a paper path;

a print head, which performs printing on the continuous paper, the print head having a first side opposing to the paper path and a second side opposite to the first side;

a cutter mechanism, overlappingly disposed with the print head, and downstream of the paper path relative to the print head, to cut the continuous paper;

a motor, disposed in the second side of the print head to provide a driving force to the paper feeding roller and the cutter mechanism; and a cutter driving mechanism, disposed in the second side of the print head to transmit the driving force of the motor to operate the cutter mechanism.

2. The printer unit as set forth in claim 1, wherein the cutter driving mechanism includes:

a worm, extending parallel with a support axis of the paper feeding roller and a rotation axis of the motor, and rotated by the driving force of the motor; and a worm wheel, which meshes with the worm to transmit the driving force to the cutter mechanism.

3. The printer unit as set forth in claim 2, wherein:

the cutter mechanism includes a movable blade formed with an elongated hole;

the worm wheel is provided with a joint extending parallel with a rotation axis of the worm wheel, and interlocked with the elongated hole; and the movable blade is reciprocated within a predetermined range in accordance with an interlocking movement of the joint in the elongated hole.

4. The printer unit as set forth in claim 3, wherein:

the cutter mechanism includes a stationary blade arranged so as to oppose the movable blade through the paper path in between; and the movable blade is brought into slidable contact with the stationary blade to scissor off the continuous paper.

5. The printer unit as set forth in claim 2, wherein the cutter driving mechanism includes a detector which detects a reference position of the worm wheel.

6. The printer unit as set forth in claim 5, wherein the detector includes a cam formed with the worm wheel, and a sensor, which senses an outer circumferential face of the cam.

7. The printer unit as set forth in claim 1, further comprising a switching mechanism, which selectively transmits the driving force of the motor to either the paper feeding roller or the cutter mechanism in accordance with a rotating direction of the motor.

8. The printer unit as set forth in claim 7, wherein:

the switching mechanism includes: a sun gear, rotated by the motor; and a pair of planetary gears, meshed with the sun gear movably around an outer periphery of the sun gear; and either one of the planetary gear meshes with one of the paper feeding roller and the cutter mechanism in accordance with the rotating direction of the motor.

9. The printer unit as set forth in claim 1, wherein the print head is a thermal head, and the paper feeding roller is a platen roller opposing to the print head.

10. The printer unit as set forth in claim 1, wherein:

the print head, the cutter mechanism, the motor, and the cutter driving mechanism are disposed at a casing body of a printing apparatus having a housing section which houses the continuous paper therein; and the paper feeding roller is disposed at a cover body of the printing apparatus which opens or closes the housing section.

11. A printing apparatus comprising the printer unit as set forth in claim 1.

* * * * *